US007514035B2

(12) United States Patent
Jones

(10) Patent No.: US 7,514,035 B2
(45) Date of Patent: Apr. 7, 2009

(54) VERSATILE HIGH VELOCITY INTEGRAL VACUUM FURNACE

(76) Inventor: William R. Jones, P.O. Box 205, Telford, PA (US) 18969

( * ) Notice: Subject to any disclaimer, the term of this patent is extended or adjusted under 35 U.S.C. 154(b) by 320 days.

(21) Appl. No.: 11/235,739

(22) Filed: Sep. 26, 2005

(65) Prior Publication Data

US 2007/0069433 A1 Mar. 29, 2007

(51) Int. Cl.
*C21D 1/06* (2006.01)

(52) U.S. Cl. ..... 266/250; 266/252

(58) Field of Classification Search ..... 266/252, 266/249–264; 432/200–205
See application file for complete search history.

(56) References Cited

U.S. PATENT DOCUMENTS

| | | | | |
|---|---|---|---|---|
| 3,988,955 | A | 11/1976 | Engel et al. | |
| 4,035,203 | A | 7/1977 | L'Hermite et al. | |
| 4,395,832 | A * | 8/1983 | Jones et al. | 34/233 |
| 4,499,369 | A | 2/1985 | Gibb | |
| 4,610,435 | A * | 9/1986 | Pfau et al. | 266/250 |
| 5,074,533 | A * | 12/1991 | Frantz | 266/254 |
| 5,121,903 | A * | 6/1992 | Ripley et al. | 266/250 |
| 5,205,873 | A | 4/1993 | Faure et al. | |
| 5,267,257 | A * | 11/1993 | Jhawar et al. | 373/110 |
| 5,348,593 | A * | 9/1994 | Bowe et al. | 148/208 |
| 5,702,540 | A | 12/1997 | Kubota | |
| 6,021,155 | A | 2/2000 | Jones | |
| 6,023,155 | A | 2/2000 | Kalinsky et al. | |
| 6,111,908 | A | 8/2000 | Jones | |
| 6,187,111 | B1 | 2/2001 | Waka et al. | |
| 7,084,068 | B2 * | 8/2006 | Suguro et al. | 438/708 |
| 2003/0168125 | A1 | 9/2003 | Goldsteinas et al. | |
| 2004/0007565 | A1 * | 1/2004 | Moller | 219/400 |
| 2005/0046095 | A1 * | 3/2005 | Shoemaker | 266/250 |
| 2007/0068601 | A1 | 3/2007 | Jones et al. | |

OTHER PUBLICATIONS

Brignoni et al., "Effects of nozzle-inlet chamfering on pressure drop and heat transfer in confined air jet impingement," International Journal of Heat and Mass Transfer 43 (2000) 1133-1139.*

* cited by examiner

*Primary Examiner*—Scott Kastler
(74) *Attorney, Agent, or Firm*—Aaron Nerenberg

(57) ABSTRACT

Versatile vacuum furnace (also having high internal pressure capability) designed for facilitating directed gas flow has a treating chamber including a long, low profile work zone configuration, and powerful gas recirculation equipment with unique structure supporting gas flow patterns that facilitate high velocity gas flow into and through the chamber. The furnace can be used for single or multiple step metal treatment processes. An entire multi step process, for example, carburizing, including gas quenching, is accomplished relatively quickly in a single self-contained chamber of the furnace.

13 Claims, 6 Drawing Sheets

VERSATILE HIGH VELOCITY INTEGRAL VACUUM FURNACE

BACKGROUND OF THE INVENTION

1. Field of the Invention

The present invention relates to low pressure carburization and other heat treating processes applied to metal alloy parts and more particularly steel parts and to high temperature capable furnaces having the capability of providing in the same furnace chamber alternatively, low pressure (vacuum) and high pressure (gas quench) environments for such processes.

2. Background Art

Vacuum (low pressure) heat treating (carburization) of steel or high alloy-content steels has been accomplished over past decades using various heat treating processes. Some alloys are particularly difficult to treat and require post treatment, for example, quenching to finish the treatment. Some metals are more difficult to treat (for example alloys such as AISI grade 4140, 4340, 8620, and 9310). Work pieces containing such alloys are currently heat treated and then moved to an oil or salt bath quench. That is, the work pieces are moved, mechanically, from the hot zone at temperature, into an outer vestibule chamber and submerged into a tank filled with oil or salt to rapidly cool the work pieces. The pieces thus moved and quenched have problems with distortion. Also, cleaning the parts after they have been submerged in oil or salt is a costly challenge. The mechanism for moving the work pieces at temperature undesirably adds significant cost, time and maintenance issues to the process. Gas quenching has been used as a post treatment for carburization of steel parts. Although, gas quenching avoids much of the finish product cleanup issues, it does not avoid the mechanical movement of the workload from one chamber to another. It also is not without challenges in how it affects finished product quality. In regard to the carburization process early and ongoing processes involve using as the carburizing gas hydrocarbons, such as, a gaseous saturated aliphatic hydrocarbon, e.g. methane, propane and butane. The selection as to which hydrocarbon should be used as the carburizing agent has been an evolving debate. The selected gas would be added at a pressure, for example, of 10-700 torr in the carburizing chamber, and the parts "absorb" carbon on the surface. Next, the reactive gas is removed and the surface carbon is allowed to diffuse below the surface. With such hydrocarbon gases, however, soot produced in the carburizing chamber interferes with desired consistency of carburizing quality and adds significant cost to parts cleanup and furnace maintenance. Achieving a uniform carburized "case", a hardened, uniform surface layer, has been difficult and costly. Uniformity has been a major challenge. Sandblasting parts prior to carburizing to get rid of surface oxidation prior to carburization became a routine requirement. Atmosphere carburization suffers from the added problem of surface oxidation during heat treatment. The use of moderately higher carburizing temperatures, compared to atmospheric carburizing conditions, over shorter carburizing times has, for example, been found to provide a more uniform oxide free carburized case depth, cleaner parts, less part distortion, and the elimination of post process machining. Over the years vacuum carburizing has become cost effective as compared to traditional atmosphere carburization. Conventional high temperature vacuum furnaces have been described in numerous prior art patents. Carburizing furnaces are in many respects similar to those conventional high temperature vacuum furnaces. In general, such furnaces are commonly of a substantially cylindrical shape having a substantially circular internal cross-section. Such a furnace is closed at its forward end by a releasable door, regularly with hinges so that the door swings out of the way for loading and unloading the furnace. The furnace doors have vacuum seals when closed to support the vacuum capability of the furnace. Also the doors regularly have insulation placed and formed to mate with insulation lining of the circular cross section furnace walls. Although the furnace of this invention has the above-mentioned features of prior art furnaces, and others, (See for example, U.S. Pat. No. 4,499,369, wherein a series of cylindrical resistance graphite heating elements are spaced longitudinally along the furnace interior and spaced from the walls.) key differences will be revealed in the following.

Consideration of the explosive and fire dangers associated with low molecular weight unsaturated hydrocarbons no doubt dissuaded some early carburization developers from attempting to use gasses such as acetylene and ethylene in carburizing applications. A relatively recent patent, U.S. Pat. No. 6,187,111 B1, (hereinafter the 111 patent) teaches away from the concept of using "acetylenic gas" as presenting "safety problems due to the combustibility of the gas." That teaching is significant, in part because it apparently takes issue with earlier studies and patents much of which apparently does not deal with the dangers so conspicuous to the 111 patent authors. The 111 patent also teaches away from using hydrogen in carburizing applications, for example, as described in U.S. Pat. No. 5,205,873, also because of the safety issue. An early study, 1982 Jelle Kassperma and Robert H. Shay. (Metall. Trans. B 13B, 1982 267), presented an intensive study of the use of hydrocarbon gases as carburizing agents. The paper reveals investigation of the carburization reaction rates for methane, ethane, propane, ethylene and acetylene. The hydrocarbons were used in a conjunction with nitrogen as the carrier gas and hydrogen as an additive. The data supported acetylene as having the fastest rate for carburization and that propane is faster than ethylene. The investigators also provided an assessment of soot formation and the benefits of hydrogen in the mixture. An even earlier use of unsaturated hydrocarbons for carburizing, including acetylene, was disclosed in U.S. Pat. No. 3,988,955, issued Nov. 2, 1976: "Suitable carbonizing gases include methane, natural gas, propane, acetylene and benzene." U.S. Pat. No. 4,035,203 also discloses the use of acetylene as an "active" gas for carburizing. About the same time Russian developers, recognizing problems associated with the use of aliphatic hydrocarbons in carburizing and the dangers of poor furnace construction, nonetheless looked to acetylene as the hydrocarbon of choice for carburizing. USSR Patent Specification No. 668978 (published patent specification date: Jun. 28, 1979, and referred to hereinafter as "USSR patent") disclosed vacuum carburizing using acetylene at a pressure in the range of "0.01-0.95 atm." (that is, 7.6 torr to 722 torr.). Interestingly, U.S. Pat. No. 5,702,540, (filed 15 plus years later, without referencing the USSR patent) claims using an acetylenic gas as the carburizing gas at a vacuum of not more than "1 kPa" (that is, not more than 7.5 torr). More recently, US Patent Application, US2003/0168125, disclosed a method for vacuum carburizing utilizing acetylene as the carburizing gas in the presence of a neutral carrier gas ($N_2$ or $H_2$) and requiring a pulsing sequence (i.e. boost/diffuse cycles). Reference is also made to the patent application filed on this date by William R. Jones et. al. entitled "Process For Heat Treating Steel Alloys" which is incorporated by reference in its entirety.

BRIEF SUMMARY OF THE INVENTION

Applicants have found that a carburizing process including heating of steel parts in the presence of hydrogen prior to introduction of carburizing/diluent gas, can provide substantial improvement in carburizing in accordance with the present invention. The process uses a continuous cycle involving only one carburizing (boost) step and one diffusion step, and carburizing gas, preferably acetylene in the presence of a diluent carrier gas. The carburizing is desirably carried out in a furnace having high velocity quenching capability. The process according to the instant invention uses hydrogen as a pretreatment gas with significant soak time under heat, then, after the pretreatment, carburizing, followed by a high pressure, high velocity gas quench. The process provides a method that avoids the need for: (a) a highly programmed cycle; and (b) a complex sequential boost/diffuse process. The process also substantially avoids the requirement for sand blasting the steel parts prior to carburizing. The process is advantageously carried out in a unique, versatile furnace that provides a novel, high velocity, continuous flow gas quenching capability, and a furnace design, including an effective work zone configuration that contributes to more effective carburization. The entire process is advantageously accomplished in a single self-contained chamber of the unique furnace. The advantages of a high velocity gas quench are substantial. For example, with the gas quench there is far less work piece distortion and no oil cleanup following heat treatment. Also, the cost of having a separate chambers and equipment for moving workloads from one chamber to another are completely avoided.

BRIEF DESCRIPTION OF THE DRAWINGS

FIG. 6B illustrates a side view cross sectional of radial hot zone gas carburizing gas nozzle 11, while

DETAILED DESCRIPTION OF THE EXEMPLARY EMBODIMENTS

Figure 1:
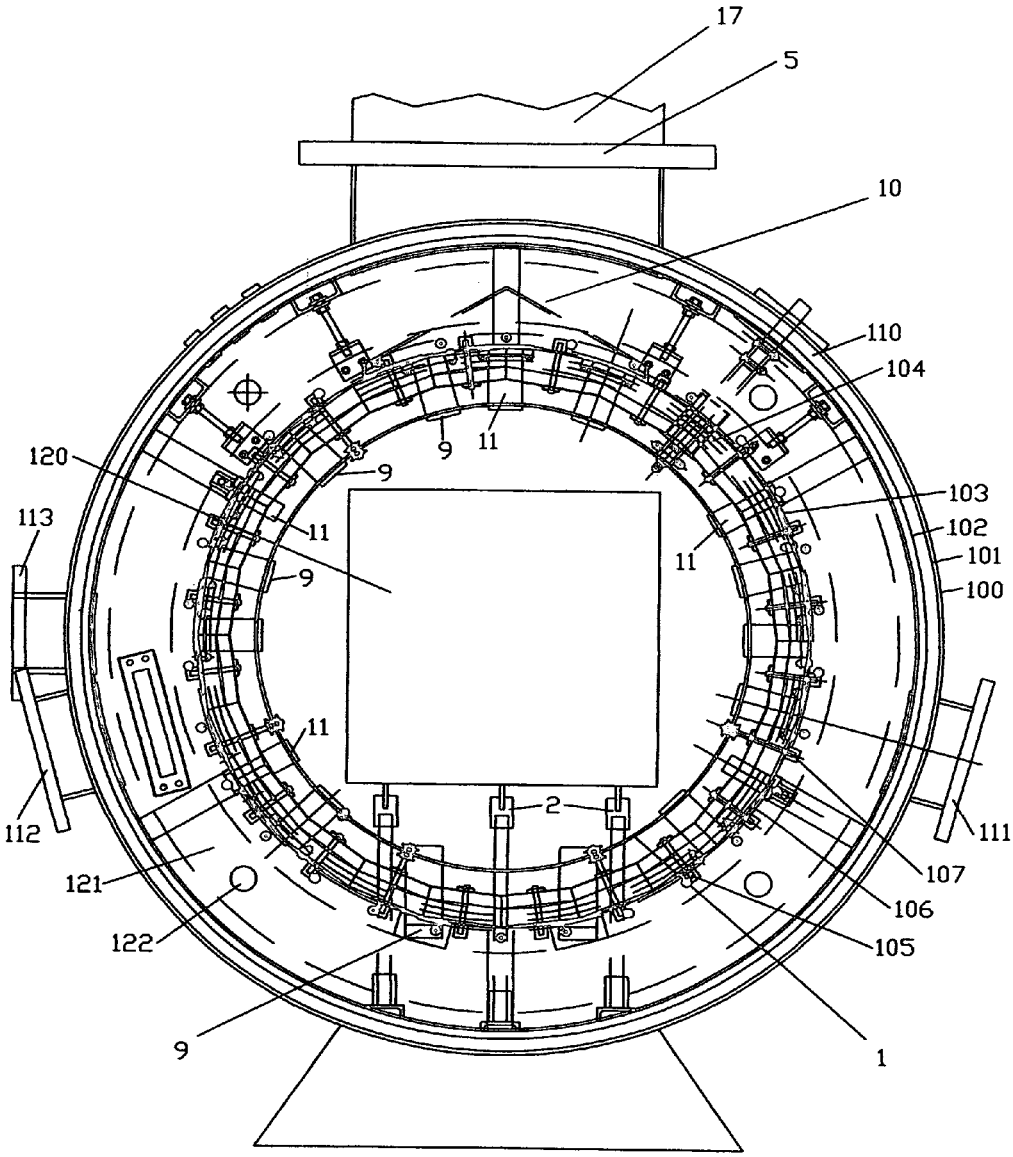
FIG. 1 depicts in perspective a partial front, open door cross section view of cylindrical resistance heating vacuum furnace 100 having high velocity quenching capability.

A front, cross section view (looking toward the door end) of high temperature, vacuum furnace 100, is depicted in perspective in FIG. 1 revealing outer furnace wall 101 and inner wall 102 which form the radial boundaries of furnace water jacket 110 used for cooling the furnace. The outer chamber of furnace 100, thus, is a cylindrical double walled water-cooled vessel, and is manufactured from 304 stainless steel. The water jacket width is approximately 1" maximum, with large oversized water inlet and exit ports (not shown) located around the chamber to allow for convenient periodic flushing of the water jacket to reduce sediment build-up. Inner wall 102 also forms the outer wall of spacious gas plenum chamber 13 (see FIG. 2), a large annular cavity important to high velocity (very rapid) quenching. Cylindrical shaped heating elements 1, each desirably graphite resistance heating elements, each forming a complete circle, are supported in place by molybdenum standoff assemblies 107 (described in U.S. Pat. Nos. 6,111,908, 6,021,155, 6,023,155) attached to and in a nonconducting relationship to support wall 103, which is the support wall for the hot zone assembly. The hot zone ring assembly comprises support wall 103, insulation 104 held in place by anchors 105, heat reflective inner surface material 106, heating elements 1, and the various assemblies and connectors anchoring them in position. Insulation layer 104 is desirably comprised of low mass insulation utilizing a 2.54 cm (one inch) thick, highly durable graphite board having bonded thereto on the board side facing the heating elements 1 a heat reflecting graphite foil, for example, 0.38 mm (0.0150 inch) thickness. The heating elements are connected to water-cooled power terminal assemblies (not shown). The furnace system is designed to operate in conjunction with: a vacuum pump capable of operating in a vacuum range of about $10^{-3}$ torr and at least one high pressure system (including, for example a surge tank) for achieving in the furnace a high pressure of at least 10 bar. Such pumps are commercially available.

To maximize carburizing furnace efficiency the effective work zone dimensions desirably will fit with and complement other furnace features and provide flexibility by accommodating a variety of target parts (workload to be carburized). The process of carburization also desirably would complement and be complemented by the furnace and its work zone dimensions. According to the present invention effective work zone 120 of furnace 100 finds a fit with and is complemented by mammoth quench gas duct 17. Duct 17, which is very large compared to ducts emptying into prior art furnaces, especially for comparable purposes, accommodates very high velocity of flow in the direction of the furnace work zone for quenching the workload placed therein, particularly with its lower angled arc that allows for lower pressure drop for the gas it passes to plenum chamber 13. Advantageously, the smallest diameter of the interior of duct 17 should be at least 50 percent as long as the diameter of the furnace hot zone (distance between an element on one side of the hot zone and the same or corresponding element on the opposing side of the hot zone). In one embodiment of the invention herein, the smallest diameter of the interior of duct 17 should be at least 70 percent (advantageously 90 percent) as long as the shortest distance across the furnace effective work zone (distance from one side of the furnace work zone to the opposing side of the work zone.) The latter relationship is illustrated in FIG.

Figure 4:
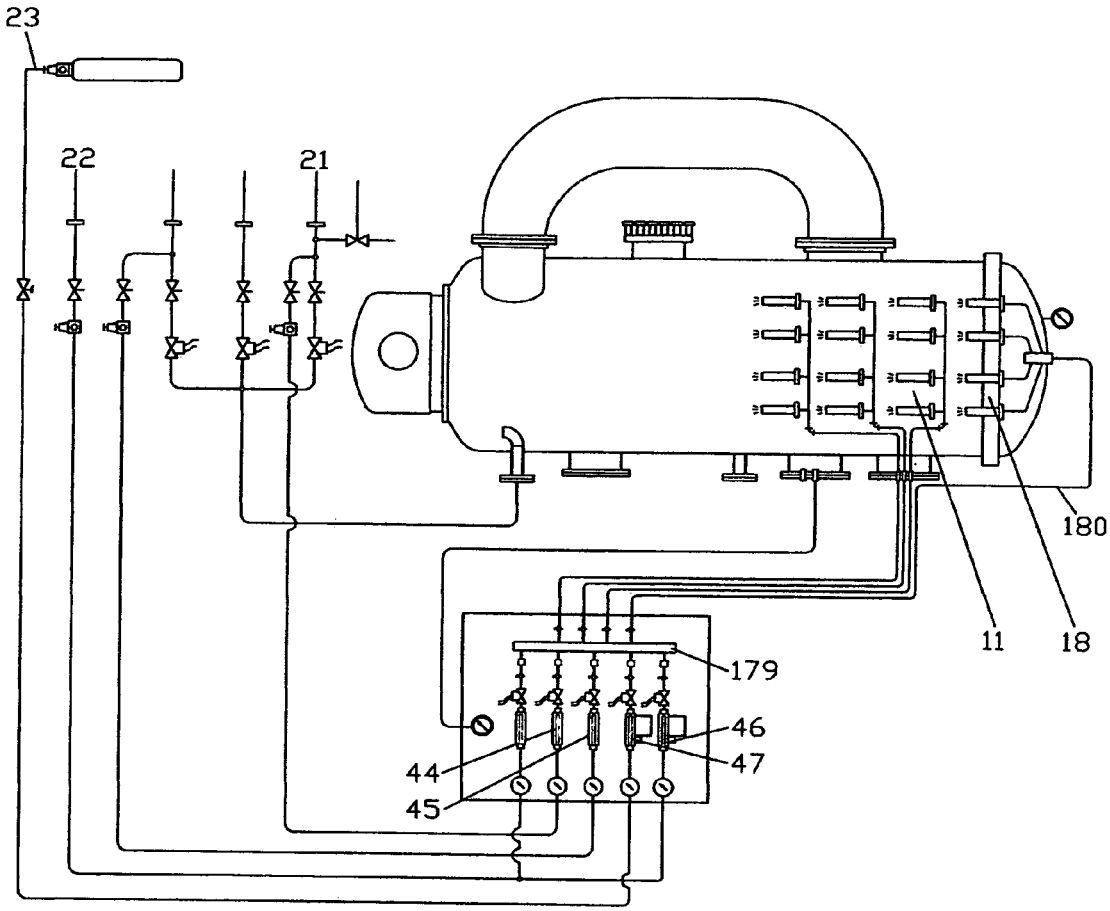
FIG. 4 is a side view schematic illustration of furnace 100 depicting (with emphasis) carburizing gas connections (rotated 90 degrees for illustration only) and gauges of the present invention.

1 wherein the diameter of duct 17 is significantly longer than 90 percent of the width or height of work zone 120. In another important embodiment of the invention, for high volume transport of the quenching gas into the furnace, the perpendicular cross section area of the duct (like duct 17) feeding from the supply source into the furnace desirably is at least as large as 50 percent (desirably at least 70 percent) of the perpendicular cross section area of the work zone of the furnace. In a particularly desirable embodiment of the invention disclosed herein, the effective work area of the furnace, work zone 120 dimensions are 24"×24"×72" (0.6×0.6×1.8 meters). An improvement over earlier furnaces results from the overall geometry of the furnace. Work zone 120 is narrow and long with a 3 to 1 ratio of length to the width or height. This allows the carburizing gas to interact with the work more efficiently, and the geometry allows greater exposure of the parts to the cooling gases, further facilitating rapid quenching. Another complementing relationship in the furnace and process according to the present invention is the minimal interruption of flow of quenching gas as it moves from mammoth duct 17 through port 5 into large gas plenum chamber 13 and then across flow director 10 so that flow of gas in gas plenum 13 is semi circumferential as well as flowing laterally, and then to the plurality of gas quenching nozzles 9. The base of each nozzle 9 (the proximal end) is: (a) radially anchored to a matching aperture in and for gas flow through inner wall 103; and (b) projects in the direction of effective work area 120. The end of each nozzle 9 proximal to inner wall 103 is attached to inner wall 103 in a location so that it extends radially into the furnace a distance so that its distal nozzle end is at least a short distance closer to effective work zone 120 than heating elements 1, thereby providing free, or only minimally obstructed, gas flow through its interior. Nozzles 9 are positioned on wall 103 so that as fixed to wall 103 their radial extensions reach between heating elements, or (in the case of the elements at the ends of the element banks) between the end element and the respective end of the furnace hot zone, to deliver from large gas plenum area 13 high velocity, balanced, even and direct flow toward and into work zone 120. The quench gas nozzles 9 are a unique high velocity threaded graphite tube, which is designed for ease of replacement. The number of quenching nozzles 9 can vary with the size of the furnace, the effective work zone volume, workload surface area and size, and spacing of the heating elements. For high velocity quenching according to the present invention for effective work zone sized: 2 feet wide, 2 feet high, and 6 feet long (0.6 m×0.6 m×1.8 m), advantageously, about 50 to 80, desirably about 70, or 71 quenching nozzles 9 are distributed in the furnace for such balanced, direct and even flow. There are additionally up to 8 quenching nozzles 9 anchored to the furnace (autoclave) door 124 for gas quench flow from the door to furnace 100 interior toward the work zone 120. Each quenching nozzle 9 is, desirably, capable of carrying quenching gas flowing at least about 322 km (200 miles) per hour. Carburizing gas nozzles 11 are also anchored in inner wall 103, and are made from graphite (or ceramic), which prevents clogging due to carbon pick-up from the carburizing source and are desirably threaded for simple replacement if necessary. Carburizing gas nozzles 11 are located at 2:00, 4:00, 8:00, and 10:00 within the cylindrical array (as viewing a clock face). The gas jet tubes 30 of carburizing nozzles 11, (see FIG. 6) are centered with a chamfer to give a more streamlined laminar flow as opposed to a turbulent flow. The flow characteristics affect the distribution of the carburizing gas to the workload. A laminar flow will give a more even distribution of the gas throughout the workload providing more efficient reactivity between the gas and the workload. The carburizing gas tube connection 42 (see FIG. 6) furnishing carburizing gas to the jet is at a 90 degree angle in order to reduce or block heat. Carburizing gas nozzles 11 are fed through smaller diameter tubing, desirably stainless steel tubing, leading from a gas source, for example, containers of highly purified hydrogen or acetylene outside furnace 100 (See FIG. 4). Desirably there are a total of twelve to sixteen carburizing gas nozzles 11 in the furnace. Four additional unique carburizing jets, nozzles 18 are anchored in furnace (autoclave) door 124 for carburizing gas flow from the door interior toward work zone 120 (see FIG. 5). Also visible in FIG. 1 are gas plenum restrictor or closure plates 121 having specific orifices 122 which, during furnace operation, advantageously channel, for example, quenching gasses into the front head quenching nozzles 9 located in the furnace door. Molybdenum work support pins 2 are fixed at their lower end to inner wall 102, and support at their upper end molybdenum work rails 3 which support hearth 7. The hearth assembly follows the pin and rail design and is completely removable. Alternatively, the hearth assembly materials include carbon fiber carbon work support pins, advanced design sculptured graphite support rails and molybdenum rod inserts. The hearth will support a gross weight up to 1500 lbs at 1316 C (2400 F) and advantageously accommodates an effective work zone 0.6 meter (2 feet) wide, 0.6 meter (2 feet) high, and 1.8 meter (6 feet) long. Desirably the effective work zone should have a length to width, and length to height ratios of at least 2.5:1, desirably at least 2.9:1, and preferably at least 3.0:1. Large quench gas port 5 and quench gas flow director 10 are further described in the context of FIG. 2. Instrumentation ports 111 and 112 as the name indicates are for connecting various aspects of the equipment internal to the furnace and, for example the vacuum carburizing control panel. Vacuum pumping port 113 is, as the name indicates, to be connected, through high stress tolerant piping, to a vacuum pump and, alternately, through an alternate high stress tolerant piping system to a high pressure system, e.g. a high pressure surge tank.

Figure 2:
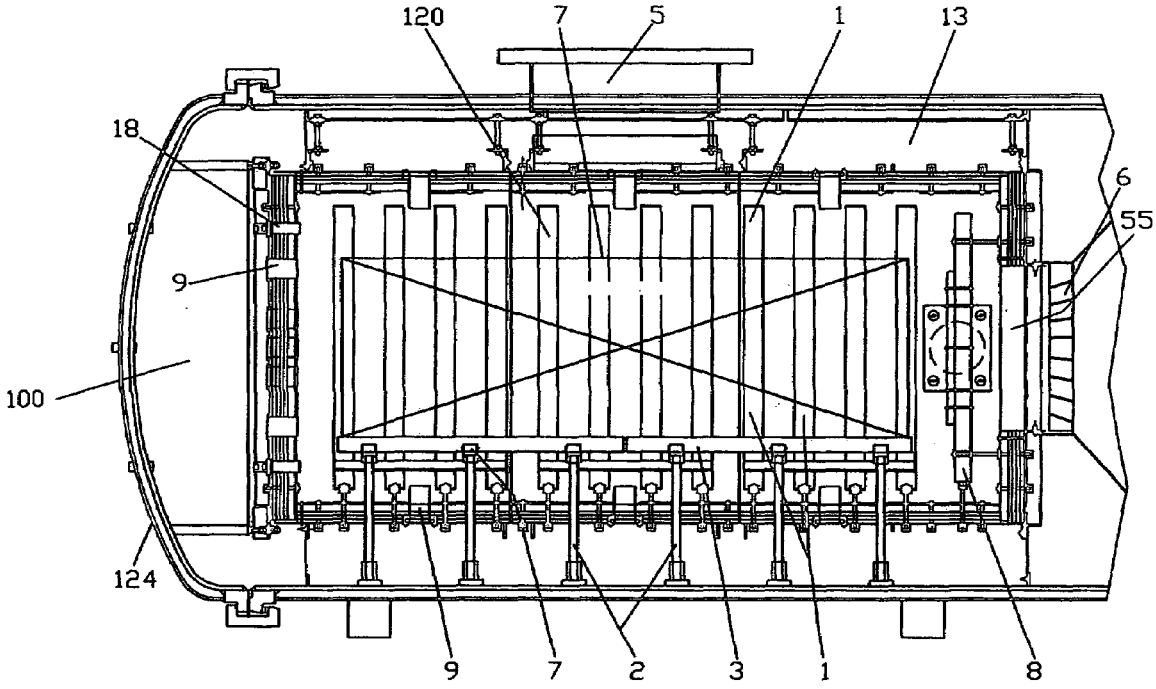
FIG. 2 depicts in partial side view cross section the front or treatment end of furnace 100.

The processing end of furnace 100 as illustrated in cross section in FIG. 2 of the invention evidences emphatically some further complimentary aspects of the instant invention. Effective work area 120 is shown as the elongated rectangle with corner to corner diagonal lines, the bottom of which is along the surface of hearth 7. As shown in FIG. 1, effective work area 120 has a generally square cross section completely surrounded by heating elements 1. As shown in FIG. 2, that "surround" continues completely along the length of the furnace hot zone. Long and narrow effective work zone 120 as described in the context of FIG. 1 is of significant benefit in promoting uniform carburizing. Large gas plenum chamber 13 (about 90% as large as the interior of furnace 100 hot zone) is also of significant benefit. Its size and configuration and outlets provide substantial opportunity for directed but relatively free flow of quench gas. Additional advantages in quench gas flow uniformity is provided by gas quench nozzles 9 extending from the interior of hollow furnace door 51 through the interior wall of the door and the insulation anchored to the door to communicate with the door interior. As mentioned above, when quench gas enters cylindrical gas plenum chamber 13 at high velocity through port 5 some of that gas passes from plenum chamber 13 into door 124 through orifices 122 in gas plenum restrictor 121. From door 124 the gas passes through 8 additional gas quench nozzles 9 to provide yet more flow toward work zone 120. The hot zone of furnace 100 when it is in the heating mode advantageously operates in the range of 260 degrees C. (500 degrees F.) and 1316 degrees C. (2400 degrees F.) with a temperature uniformity within the furnace of 427 to 93 degrees C. +/−5.6 C (800 to 200 degrees F. +/−10 F). The system is designed to operate in conjunction with a roughing pump (commercially available). In the heating mode of the furnace, reflective heat radiation baffle 8 reflects heat back to the furnace hot zone and away from equipment in the furnace end opposite the door end. Behind reflective heat radiation baffle 8 is a generally circular gas exit port 55 which in operation, for example in quenching mode, allows gas to pass from the furnace interior through gas diffuser baffle 6 into the all copper, gas to water, vacuum tight fin tube heat exchanger 14 included in FIG. 3.

Figure 3:
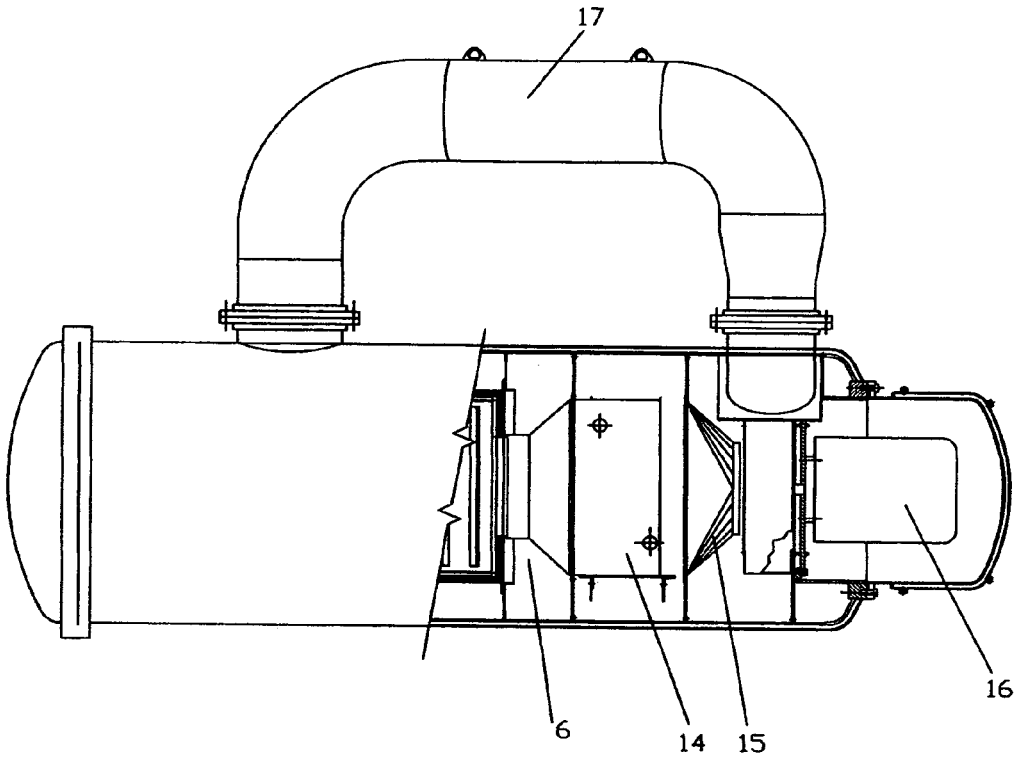
FIG. 3 depicts in partial cutaway a side cross section view revealing features in the gas supply and movement end of the furnace 100.

Important additional embodiments of the instant invention which also complement the overall effectiveness of the furnace are revealed by the equipment and the processes used in conjunction with the operation of vacuum tight fin tube heat exchanger 14 and the other equipment depicted in FIG. 3. It is particularly so as the process moves from a heating and or vacuum mode to a very high pressure cooling mode. Because the capital invested in such furnaces is significant, furnace owners want to keep the overall treatment time for each workload as brief as is practical while producing high quality product. Thus, decreasing the quench time provides significant advantage in cost, and has been found to be another advantage provided by the instant invention. The use of large heat exchanger 14 together with gas quench blower 16 having a 300 horsepower motor provide additional significant complement to the furnace design. Heat exchanger 14 provides cooled gas through gas inlet collector 15, which focuses the gas flow from the heat exchanger into a fan scroll housing (not shown) for recirculation forced by gas quench blower (fan) 16. The cooling system comprising a blower (fan) that has a 300 hp motor for very high velocity gas flow, a low resistance to flow, vacuum tight, straight through, all copper water cooled fin and tube designed heat exchanger, is designed to support a 10 bar gas quenching system. Blower 16 has a radial fan wheel and a fan scroll which acts as a pump or compressor which pushes the gas straight up toward low pressure drop, high volume gas return duct 17. The design of the low pressure drop high volume duct is significant due to the fact that there are no sharp right angles the gas has to pass through. This gently curving, large radius, duct 17 prevents large pressure drops from occurring, thus minimizing the potential for turbulence. The ability to maintain the pressure as the gas is passing through the heat exchanger, blower and return duct allows the gas to be driven at a very high velocity, upwards of 327 kmph (200 mph) through the quenching nozzles and toward the workload at such speeds to provide faster quenching than in the prior art. Quench gas nozzles 9 are a unique high velocity threaded graphite tube, which is designed for ease of replacement. Advantageously, a total of 8 quench gas nozzles are functionally anchored in the autoclave door and at least 60 to 70+ gas nozzles evenly distributed throughout the ring assembly to surround the workload. Quench gas nozzles 9 are directed toward the workload to maximize the cooling capability while giving a uniform quench. The delivery gas jets have an internal taper to maximize the gas velocity. Gas flow plenum chamber 13 is also cylindrical.

The process for carburizing in accordance with one embodiment of the invention herein involves loading high integrity furnace 100 with pieces to be carburized by placing the pieces in furnace work zone 120 and closing furnace door 124. Furnace 100, is thereafter evacuated, i.e., removing substantially all gas (or "drawing a vacuum", in vacuum furnace parlance) from furnace. The high integrity furnace must have a leak rate of 5 microns (Hg) or less per hour. In addition all gases used in the process must be of the highest purity, The purest grade commercially available. Impurities found in lower grade gases, according to the present invention have been found to contribute to soot formation and product contamination. Also, before each carburizing run all gas feed lines are to be bubble tested to ensure they are effectively leak free. After the vacuum has been drawn, in accordance with an important embodiment of the present invention, highly purified hydrogen (again, the purest quality available) is piped into furnace 100 through leak free conduit to a relatively low pressure (for example, partial pressure 4.5 torr.). Because the furnace is under intense, practically complete vacuum at the start of the hydrogen transfer into the furnace the transfer and distribution occurs quickly, uniformly and completely as hydrogen seeks to fill the furnace. When the pressure reaches at most 8 torr, the furnace temperature is then increased to about 954 C (1750 F). The pieces to be carburized are in that heated hydrogen environment (hydrogen soaked) for about one hour, typically 60-65 minutes. The hydrogen soak has been found to be particularly effective in oxide removal prior to carburizing. The hydrogen also serves to activate or open the surface of the pieces thereby facilitating carburizing. Additional hydrogen or other high purity diluent is then added to a pressure of at least 8 torr. (The term "at least 8 torr" herein means the pressure is not lower than 8 torr.) High purity carburizing gas, advantageously acetylene, is then inserted into the furnace having hydrogen therein, thus gradually displacing some but not all of the hydrogen to carburize the workload at a pressure of at least 8 torr, desirably between 8 and 15 torr, and advantageously between 8 and 10 torr. Utilizing established data based on a solution of Fick's Law of Diffusion and the known ratio R, which relates diffuse time to carburizing time) carburizing cycles can readily be developed to result in case depths in the range of 0.035", a surface carbon content of approximately 0.8%, and Rockwell hardness values in the low to mid 60's.

Because furnace 100 according to the present invention is versatile and will be used for treating several different metals (alloys) it is desirable to have piped connections for channeling various gasses into and out of the furnace. The specific needs for many furnaces according to the instant invention may vary. Drawing 4 is not to scale, and is for illustration of desirable components of the furnace rather than a precise engineering drawing, that is, a schematic of furnace 100 illustrating by example the array of controllers, meters, motors, etc. that provide some detail as to the complexity of such equipment confronting the personnel of ordinary skill in this art. Furnace 100 with its mammoth duct 17 is shown in partial phantom with carburizing nozzles 11 (rotated for illustration only) and carburizing nozzles 18 extending through door 124. Carburizing gas line 23 connects the gas cylinder to gas manifold 179 via a high accuracy mass flow controller 47. Hydrogen gas line 22 is also connected to gas manifold 170 via mass flow controller 46. Nitrogen gas line 21 and hydrogen gas line 22 are also connected to gas manifold 179 via partial pressure flow valves 44 for hydrogen and 45 for nitrogen. Carburizing gas mixtures are fed through gas manifold 179 to the gas carburizing nozzles with a separate line 180 directing the carburizing gas to interior door nozzles 18. Trim valves allow the control of the carburizing gas distribution between the different carburizing gas nozzles. 19. A particularly effective carburizing process in accordance with this invention includes varying the flow rate of the carburizing gas at regular intervals, for example, every five to ten minutes, in a descending direction and increasing the flow rate of the diluent gas correspondingly, thereby maintaining an absolute pressure of at least 8 torr.

Figure 5A:
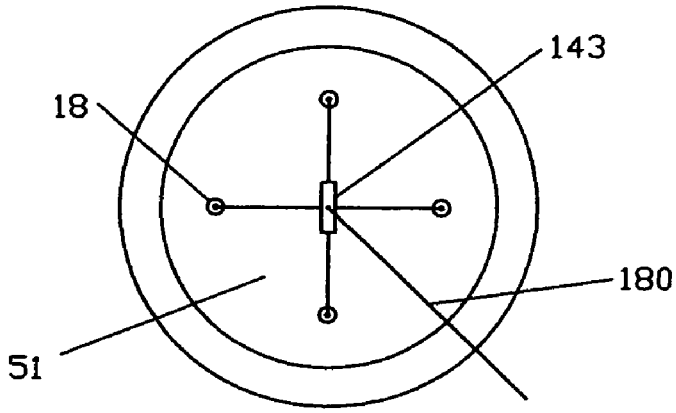
FIG. 5A depicts in partial cutaway of furnace (autoclave) door 51 inside (as viewed from the interior of furnace 100) illustrating connected carburizing gas nozzle arrangement in the door and schematically illustrating the gas supply tubes.
Figure 5B:
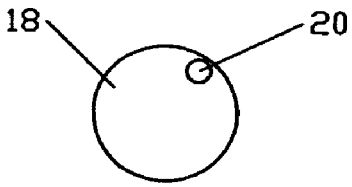
FIG. 5 B depicts an end view of carburizing nozzle 18) as viewed from furnace 100 interior.
FIG. 5C depicts in cross section the taper of carburizing nozzle 18.
Figure 5C:
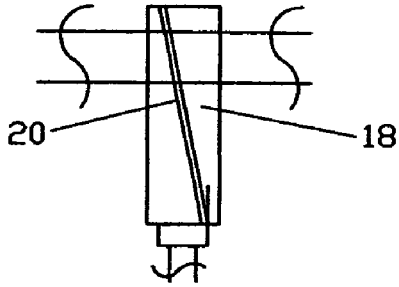

To further improve carburizing efficiency the design of carburizing gas nozzles 18 shown in FIG. 5A and their arrangement within the autoclave door desirably fit in a uniform arrangement at 12:00, 3:00, 6:00, and 9:00 as on the face of a clock. Nozzles 18 are designed as graphite threaded units for ease of replacement and freedom from clogging. Alternatively the nozzles can be manufactured with ceramic materials. The gas mixtures, which are delivered from stainless steel line 180, enter manifold 143 before being evenly distributed over the 4 carburizing nozzles 18. The nozzle heads have an internal jet tube 20 shown in FIGS. 5B and 5C which is not centered but angled. This angled design controls the carburizing gas flow from the interior of the door toward the center of the workload. The aperture size can be 1.59 mm-3.96 mm, desirably 3.96 mm.

Figure 6A:
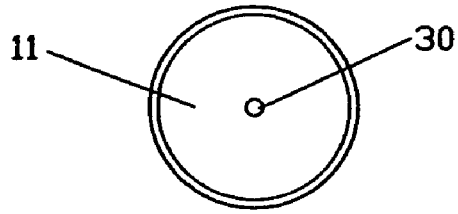
FIG. 6A depicts an end view of radial hot zone gas carburizing gas nozzle 11.
Figure 6B:
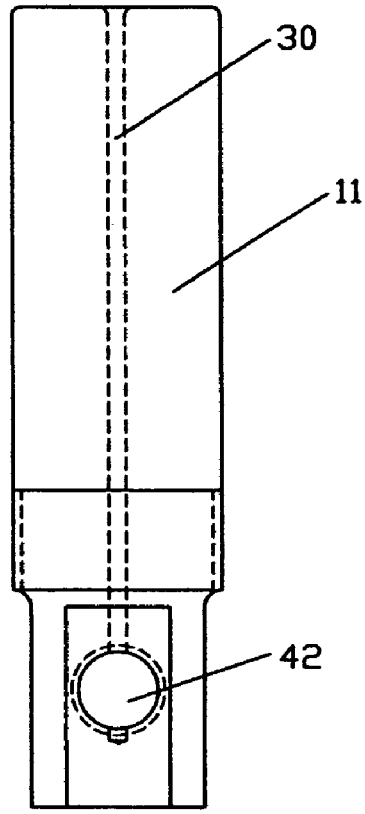
Figure 6C:
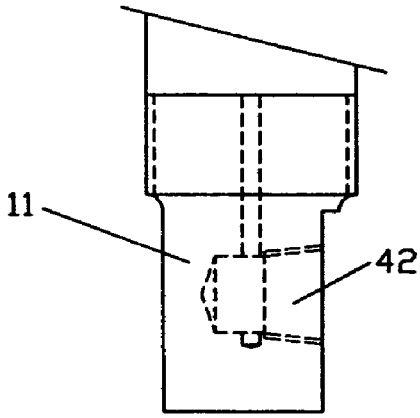
FIG. 6C illustrates a 90 degree lateral rotational view of the lower segment of carburizing gas nozzle 11 illustrated in FIG. 6B.
Figure 6D:
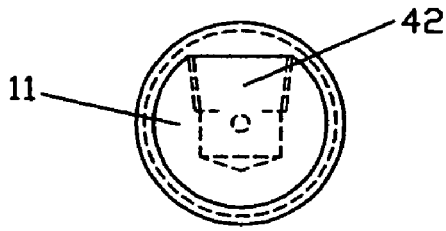
FIG. 6D is a cross sectional view along line Z-Z of carburizing gas nozzle 11 connection.

Even further improvements in carburizing efficiency within the furnace chamber derive from the design of internal furnace carburizing nozzles 11, which were designed as graphite threaded nozzles for ease of replacement and freedom from clogging. Internal jet tube 30, as shown in FIGS. 6A and 6B, is centered with a chamfer to give a more streamlined laminar flow as opposed to a turbulent flow. The centered alignment gives efficient and direct gas flow from nozzle 11 to the workload. The internal diameter of the gas jet tubes can be 1.59 mm-3.96 mm, with 3.96 mm as a desired diameter. Carburizing gas connect tube 42, as shown in 6B-6D, is at a 90 degree angle in order to reduce or block heat.

As noted above, versatile furnace 100 and the investigation of how to use it most beneficially has opened the way for different and economic processes for heat iron-containing alloys and especially for carburizing. For metal treatment that reaction can be sensitive to a number of different interactions with impurities. Having the metal cleaned by chemical purification in the same chamber in which it is to be subjected to later treatment by heat and, and, or chemicals and, or pressure change would not be acceptable UNLESS, as is the case with the instant invention, the undesirable bi-products of the cleaning were completely removed from the chamber after the cleaning and before the treatment. The chemical and physical (high and low pressure and temperature environments, as well as high velocity gas flow) that are necessary and desirable for metal treatment are also fraught with the potential for adding additional undesirable impurities during the various physical and chemical changes taking place in or on the metal surface. The following list includes some of the important factors according to the present invention helping to tame this very complex technical challenge in addition to the high quality furnace described above:

1. high purity source of gases such as hydrogen, acetylene, ethylene, propane, nitrogen and argon that can supplied through gas lines into the chamber to a controlled level.
2. low vacuum capability, e.g., to evacuate the chamber, high pressure capability to operate at a pressure level of 10 bar, and very high gas-circulating capability, and gas transport lines for providing gas to and drawing gas from the chamber with the ability to control low pressures, for example to at least within 0.1 torr
3. heating capability and instruments for controlling temperatures for heating in the range of 30 C up to at least 1316 C with a temperature, including the ability to heat the furnace to 954 C and hold that temperature for 60 to 65 minutes for example to soak the workload in hydrogen for that length of time.
4. The capability to quench very rapidly by releasing quench gas into the chamber and recycling the gas at a high rate.
5. Having well articulated processes with well defined guidelines that include, for example: treating (in a specific chamber of a heat treating vacuum furnace having low vacuum capability, high pressure capability, and very high gas-circulating capability), with gas transport lines for providing gas to and drawing gas from said chamber, surfaces of steel alloy work pieces, by:
   (a) drawing a very low pressure vacuum to evacuate gas from the chamber;
   (b) allowing hydrogen to flow through a gas line into the chamber to a pressure not exceeding 10 torr;
   (c) heating the chamber to a temperature up to, desirably, 954 C and soaking the work pieces in that heat for at least 60 to 65 minutes, and then adjusting the pressure to at least 7.6 torr by adding gas as necessary;
   (d) while maintaining the pressure at a level of at least 7.6 torr, (at a pressure no lower than 7.6 torr) and at a temperature at 954 C adding to said chamber through at least one said gas line, gas having a capability of desirably affecting said surfaces 9 for example a carburizing gas and then
   (e) after allowing the work pieces to diffuse for time dependent upon, the work load composition, e.g., the alloy make up and then
   (f) shutting off the heating mechanism and very rapidly quenching by releasing large quantities of quench gas at high pressure into said chamber and recycling the quench gas at a high rate of speed.

Although specific embodiments of the present invention have been described above in detail, it will be understood that this description is merely for purposes of illustration. Various modifications of, and equivalent steps corresponding to, the aspects of the preferred embodiments, in addition to those described above, may be made by those skilled in the art without departing from the spirit of the present invention defined in the following claims, the scope of which is to be accorded the broadest interpretation so as to encompass such modifications and equivalent embodiments.

What is claimed is:

1. A vacuum furnace for carburizing and gas quenching a stationary work piece in the same furnace chamber, having low pressure capability down to approximately $10^{-3}$ torr and high pressure capability up to approximately 10 bar comprising a single furnace body chamber and an access door, said single furnace body chamber including a work zone having a length to height ratio of at least 3 to 1 and having a plurality of centered jet tube carburizing nozzles, each of said carburizing nozzles having a chamfer thereon and being located throughout said work zone for maximizing radial distribution of a low pressure reactant gas over the work piece, and said access door being operatively attached to said furnace body and including a plurality of angled jet tube carburizing nozzles located in said door for maximizing longitudinal distribution of the low pressure reactant gas over the work piece, said work zone and said access door each further including a plurality of high velocity gas quench nozzles located throughout said work zone and said access door for providing a high pressure quench gas up to approximately 10 bar to the stationary work piece located in said work zone, and said single furnace body chamber further including an outer wall, an inner wall and a plenum therebetween, said inner wall forming the exterior of said work zone, and said plenum being formed to receive the quench gas at a pressure up to approximately 10 bar and a speed up to approximately 322 km/hr, said furnace further including a large curved external duct operatively attached to said single furnace body chamber, said duct having a low angle arc with no sharp corners for producing a low pressure drop of the quench gas, and wherein the diameter of said duct is larger than approximately 70% to 90% of the shortest work zone dimension.

2. A vacuum carburizing furnace in accordance with claim 1 wherein said single furnace body chamber is cylindrical and said plurality of centered chamfered jet tube carburizing nozzles are located evenly throughout said cylindrical chamber at approximately 2, 4, 8 and 10 o'clock.

3. A vacuum carburizing furnace in accordance with claim 2 wherein said cylindrical furnace body chamber contains between approximately 12 and 16 centered chamfered jet tube carburizing nozzles.

4. A vacuum carburizing furnace in accordance with claim 1 wherein said plurality of angled jet tube carburizing nozzles are located in said access door at approximately 12, 3, 6 and 9 o'clock.

5. A vacuum carburizing furnace in accordance with claim 4 wherein said access door contains approximately 4 angled jet tube carburizing nozzles.

6. A vacuum carburizing furnace in accordance with claim 2 wherein said cylindrical furnace body chamber contains between approximately 50 and 71 high velocity gas quench nozzles evenly distributed throughout said cylindrical chamber.

7. A vacuum carburizing furnace in accordance with claim 6 wherein said cylindrical furnace body chamber contains between approximately 70 and 71 high velocity gas quench nozzles.

8. A vacuum carburizing furnace in accordance with claim 1 wherein said access door contains approximately 8 high velocity gas quench nozzles evenly distributed throughout said access door.

9. A vacuum carburizing furnace in accordance with claim 1 wherein said furnace includes a fan motor capable of providing gas flows through said gas quench nozzles at speeds up to approximately 322 km/hr.

10. A vacuum carburizing furnace in accordance with claim 1 wherein said furnace is oriented horizontally with said access door being located adjacent one end of said single furnace body chamber.

11. A vacuum carburizing furnace in accordance with claim 1 wherein said plenum is cylindrical and circumscribes said work zone for providing said quench gas to said work zone.

12. A vacuum carburizing furnace in accordance with claim 1 wherein the diameter of said external duct is at least approximately 75% as long as the shortest work zone dimension.

13. A vacuum carburizing furnace in accordance with claim 1 wherein the diameter of said external duct is at least approximately 90% as long as the shortest work zone dimension.

* * * * *